US005879141A

United States Patent [19]

Yokozawa et al.

[11] Patent Number: 5,879,141

[45] Date of Patent: Mar. 9, 1999

[54] AIR FAN FOR COOLING ELECTRONIC COMPONENT

[75] Inventors: Shinjiro Yokozawa, Tokyo; Nobumasa Kodama, Ueda; Toshiki Ogawara, Nagano-ken, all of Japan

[73] Assignee: Sanyo Denki Co., Ltd., Tokyo, Japan

[21] Appl. No.: 672,374

[22] Filed: May 29, 1996

[30] Foreign Application Priority Data

May 31, 1995 [JP] Japan ..... 7-134393

[51] Int. Cl.[6] ..... F04B 17/03

[52] U.S. Cl. ..... 417/423.7; 415/203; 310/62

[58] Field of Search ..... 417/423.7, 371, 417/410; 415/208.1, 182.1, 206, 203; 416/244 R, 247, DIG. 7; 310/62, 60 R, 60 A, 63

[56] References Cited

U.S. PATENT DOCUMENTS

| | | | |
|---|---|---|---|
| 3,521,978 | 7/1970 | Enemark | 417/371 X |
| 3,891,355 | 6/1975 | Hecht et al. | 417/371 |
| 4,164,690 | 8/1979 | Muller et al. . | |
| 4,904,891 | 2/1990 | Baker et al. . | |
| 4,959,571 | 9/1990 | Yasumoto et al. . | |
| 5,257,901 | 11/1993 | Malchow | 415/182.1 |
| 5,296,796 | 3/1994 | Havens et al. . | |
| 5,379,999 | 1/1995 | Barzideh et al. . | |
| 5,597,287 | 1/1997 | Helmick | 415/206 X |
| 5,676,523 | 10/1997 | Lee | 415/206 |

FOREIGN PATENT DOCUMENTS

| | | |
|---|---|---|
| 251915 | of 1985 | Japan . |
| 253597 | of 1989 | Japan . |
| 231940 | of 1990 | Japan . |
| 231941 | of 1990 | Japan . |

*Primary Examiner*—Ismael Izaguirre
*Attorney, Agent, or Firm*—Pearne, Gordon, McCoy & Granger LLP

[57] ABSTRACT

An air fan capable of increasing the amount of air fed in a radial direction thereof. An impeller which includes a plurality of blades for sucking air from one side in an axial direction of a revolving shaft of a motor and guiding sucked air mainly toward the other side in the axial direction is mounted on a rotor of the motor. A casing includes a peripheral wall arranged so as to define a cavity therein in which the motor and impeller are received. A cavity is closed at each of both ends in the axial direction with a closing wall. The peripheral wall is provided at a portion thereof in proximity to an end thereof on the one side with a lateral suction port which permits air to be suckedly introduced therethrough into the cavity in a radial direction of the revolving shaft. Also, the peripheral wall of the casing is provided at a portion thereof in proximity to an end thereof on the other side with a lateral discharge port which permits air suckedly introduced into the cavity to be discharged therethrough in the radial direction. The lateral suction port and lateral discharge port are arranged so as not to be aligned with each other in the axial direction.

15 Claims, 5 Drawing Sheets

AIR FAN FOR COOLING ELECTRONIC COMPONENT

BACKGROUND OF THE INVENTION

This invention relates to an air fan, and more particularly to an air fan adapted to be received in a receiving housing of an electronic appliance to cool an electronic component.

Japanese Patent Application Laid-Open Publications Nos. 231940/1990 (2-231940) and 231941/1990 (2-231941) each disclose an air fan constructed so as to flow feed in a radial direction thereof perpendicular to an axial direction thereof by means of an axial fan. The air fan is generally called a radial fan in the art. An axial fan includes an impeller securely mounted on a revolving shaft of a motor. The impeller is provided with a plurality of blades and constructed so as to suck air on one of both sides defined in an axial direction of the revolving shaft of the motor and guide it toward the other side. Also, the impeller is arranged in a cylindrical cavity which is defined by a peripheral wall of a casing. The axial fan exhibits characteristics capable of increasing the amount of air fed while keeping a pressure at a reduced level. The radial fan was developed utilizing such advantageous characteristics of the axial fan. Thus, the radial fan exhibits characteristics capable of increasing the amount of air fed while being decreased in thickness or depth as compared with a cross-flow fan or a cirrocco fan and reducing noise as compared with a cirrocco fan.

The conventional radial fan described above is so constructed that the cavity in which the impeller is received is closed at one end thereof with a wall and provided with a lateral discharge port, which is formed by removing a part of a peripheral wall of the casing. The lateral discharge port is provided so as to thoroughly extend from one end of the cavity to the other end thereof, so that the blades of the impeller each are fully exposed from the lateral discharge port of the casing when it faces the port during rotation of the impeller.

The inventors made such a radial fan as described above utilizing the axial fan and conducted an experiment on the radial fan thus made. As a result, it was found that the radial fan causes the amount of air discharged from the lateral discharge port and blown against a component being cooled to be less than expected.

Also, when the conventional radial fan is received in a receiving housing of an electronic appliance decreased in thickness or depth, it causes the amount of air fed to be excessively decreased or rendered substantially zero.

SUMMARY OF THE INVENTION

The present invention has been made in view of the foregoing disadvantage of the prior art.

Accordingly, it is an object of the present invention to provide an air fan which is capable of significantly increasing the amount of air fed.

It is another object of the present invention to provide an air fan which is capable of effectively feeding a required amount of air even when it is arranged in a receiving housing of an electronic appliance decreased in thickness or depth.

It is a further object of the present invention to provide an air fan for cooling an electronic component which is capable of effectively feeding a required amount of air even when it is arranged in a receiving housing of an electronic appliance decreased in thickness or depth.

It is still another object of the present invention to provide an air fan which is adapted to suck in air in a radial direction thereof and discharge it in the radial direction.

It is a still further object of the present invention to provide an air fan which is capable of effectively cooling an electronic component generating heat, even when a space in a receiving casing of an electronic appliance in which the electronic component cooling apparatus is arranged is reduced.

In accordance with the present invention, an air fan is provided which includes a motor including a rotor and a stator, an impeller securely mounted on the rotor and including a plurality of blades for sucking air from one side (suction side) in an axial direction of a revolving shaft of the motor and guiding sucked air mainly toward the other side (discharge side) in the axial direction, and a casing including a peripheral wall arranged so as to define a cavity therein in which the motor and impeller are received. In the air fan of the present invention generally constructed as described above, the casing includes closing walls for closing both ends thereof defined in the axial direction. The casing may be constructed of a pair of casing halves each including each of the closing walls.

The peripheral wall of the casing is provided at a portion thereof in proximity to an end thereof on the above-described one side or suction side with at least one lateral suction port which permits air to be suckedly introduced therethrough into the cavity in a radial direction of the revolving shaft. The peripheral wall may be constructed in any way so long as it effectively provides the cavity which permits the impeller to be rotated therein. For example, the peripheral wall may include a cylindrical wall arranged so as to surround the impeller. The lateral suction port is arranged so as to face at least in a radial direction of the revolving shaft. It may face the one side or suction side.

The peripheral wall of the casing is provided at a portion thereof in proximity to an end thereof on the other side or discharge side with at least one lateral discharge port which permits the air suckedly introduced into the cavity to be discharged therethrough in the radial direction of the revolving shaft. The lateral discharge port is formed so as to prevent air circulation which causes a large amount of air discharged from the lateral discharge port to be suckedly returned through the lateral suction port to the cavity immediately after the air is once discharged through the discharge port. The lateral discharge port may be arranged so as to face at least in the radial direction of the revolving shaft. It may face the other side or discharge side.

When the casing is constructed of a pair of casing halves, one of the casing halves is formed with the lateral suction port and the other casing half is formed with the lateral discharge port. Thus, preparation of various kinds of casing halves different in the number of lateral suction ports and lateral discharge ports and position of the ports permits various kinds of such casings which are different in the number ports and position thereof to be readily provided.

In the present invention, the lateral suction port and lateral discharge port are formed so as to prevent air circulation which a large part of air discharged through the lateral discharge port to be suckedly returned through the lateral suction port to the cavity immediately after the discharge. More specifically, the lateral suction port and lateral discharge port are arranged so as not to be aligned with each other or be in a row in the axial direction.

The above-described closing of both ends of the cavity in the axial direction with the closing walls permits a thickness or depth of a receiving housing of an electronic appliance to be reduced to a degree sufficient to cause the receiving casing to be contacted with both ends of the air fan in the axial direction. However, it was found that this fails to feed a sufficient amount of air depending on arrangement of the closing walls even when the lateral suction port is formed at the peripheral wall of the casing. More particularly, it was found that a decrease in distance between the closing wall of the air fan on the suction side and the blades to a predetermined level or more causes the air fan to substantially fail in feeding of air.

Thus, the casing is preferably formed so that a space between the closing wall and the blades may establish a suction pressure sufficient to permit a sufficient amount of air to be suckedly introduced through the lateral suction port into the cavity. This may be realized by increasing a length of the peripheral wall of the casing in the axial direction.

In order to increase cooling efficiency or the amount of air discharged through the lateral discharge port, it is essential to prevent "air circulation" which causes a large part of air discharged from the discharge port to be suckedly returned through an open end of the cavity on the one side into the cavity. The inventors made various experiments and as a result, it was found that the reasons why the conventional fan described above fails in satisfactory feeding of air are that a discharge port is arranged so as to extend over one end of a cavity to the other end thereof, resulting in each of blades of an impeller being exposed through the discharge port when it faces the port during rotation of the impeller. Such full exposure of the blade through the discharge port causes the above-described air circulation. The air circulation causes suction of fresh ambient air into the cavity to be decreased in an amount corresponding to the amount of air suckedly returned to the cavity due to the air circulation. Ideally, it is preferable that the lateral suction port and lateral discharge port are provided so as to fully prevent the air circulation. In this connection, the above-described object of the present invention can be accomplished by reducing the air circulation.

In a preferred embodiment of the present invention, the blades of the impeller are arranged so as to guide the sucked air in the radial direction to the utmost. Even the impeller for the axial fan permits air to be fed in the radial direction by centrifugal force due to rotation of the impeller. In this instance, the blades are preferably designed so as to permit air to be fed as much as possible in the radial direction by the centrifugal force. The impeller thus designed substantially increases the amount of air fed as compared with the conventional impeller for the axial fan.

In a preferred embodiment of the present invention, the peripheral wall may be formed of four side walls into a substantially rectangular outer configuration. In this instance, at least one of the side walls of the peripheral wall of the casing is provided with the lateral discharge port and at least one of the remaining side walls of the peripheral wall of the casing is provided with the lateral discharge port, resulting in the air circulation being prevented. The lateral suction port is preferably provided at at least one side wall adjacent to the side wall provided with the lateral discharge port.

The air fan of the present invention may be arranged in the receiving housing of the electronic appliance in various manners. For example, the air fan may be juxtaposed to the electronic component while being adjacent to the electronic component. Also, the air fan is arranged so as to permit air discharge through the lateral discharge port to be directly blown against the electronic component or a heat sink arranged with respect to the electronic component.

Also, the electronic component cooling air fan may be securely mounted on the heat sink.

As described above, the air fan of the present invention is so constructed that the peripheral wall of the casing is provided with the lateral suction port and lateral discharge port, which are arranged so as not to be aligned with each other in the axial direction, to thereby prevent air circulation which causes a large part of air discharged from the lateral discharge port to be suckedly introduced into the cavity through the lateral suction port immediately after the discharge. Such construction permits air sucked from the lateral suction port to be discharged in the radial direction from the lateral discharge port, to thereby ensure feeding of air in a sufficient amount. In particular, the air fan of the present invention eliminates a necessity of providing any specific space on each of both sides in the axial direction thereof, because the cavity is closed at both ends thereof in the axial direction. Thus, arrangement of the air fan of the present invention for cooling an electronic component of an electronic appliance is significantly facilitated.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an air fan according to the present invention will be described hereinafter with reference to the accompanying drawings.

Figure 1:
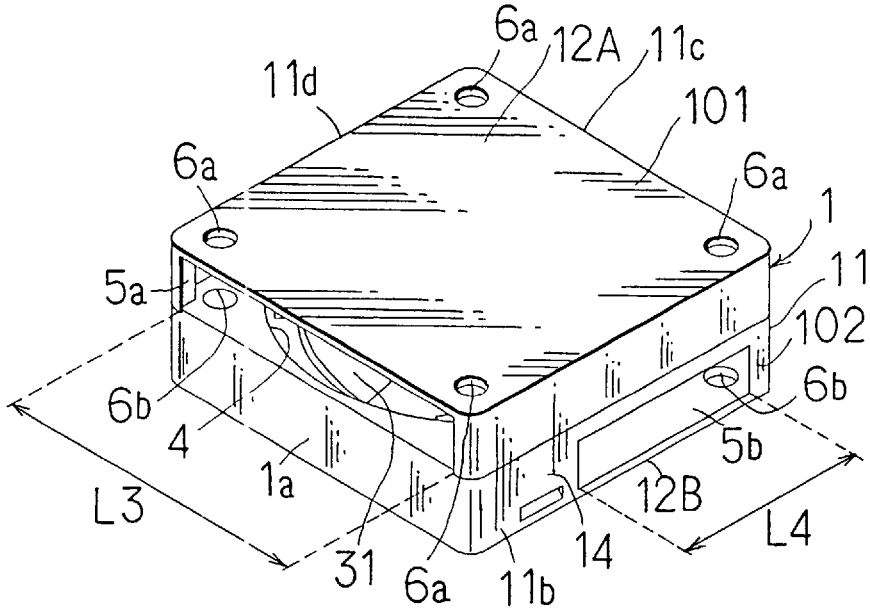
FIG. 1 is a perspective view showing an embodiment of an air fan according to the present invention.
Figure 2:
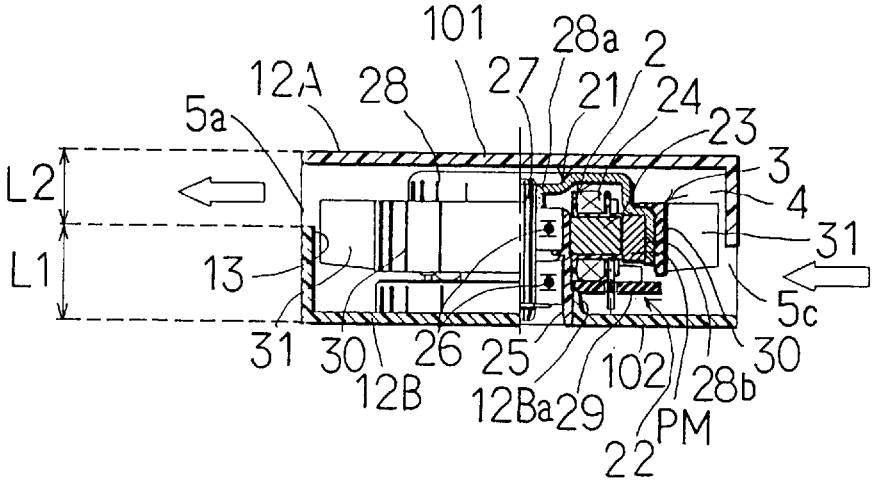
FIG. 2 is a sectional view of the air fan shown in FIG. 1.
Figure 3:
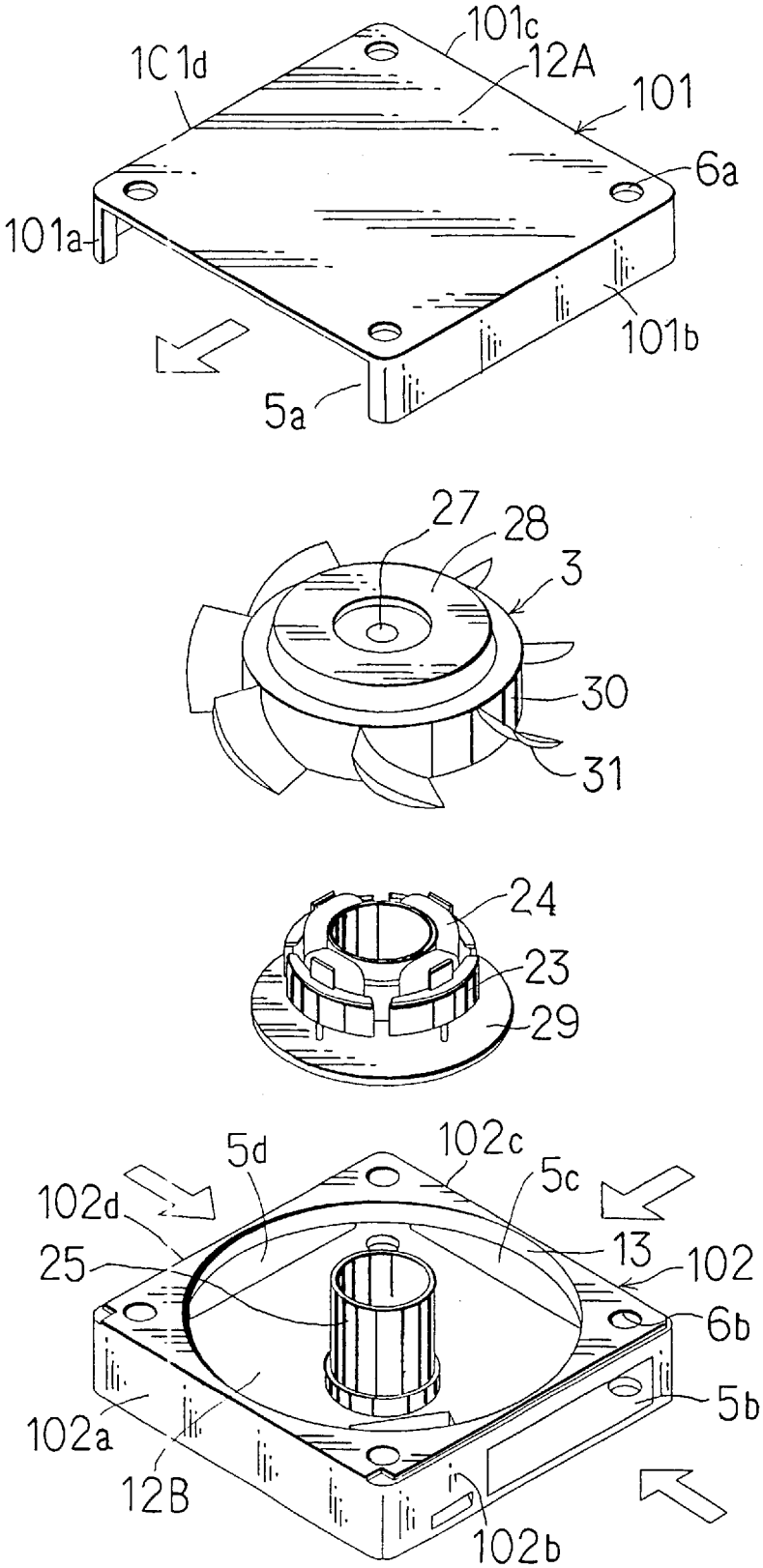
FIG. 3 is an exploded perspective view of the air fan shown in FIG. 1.

Referring first to FIGS. 1 to 3, an embodiment of an air fan according to the present invention is illustrated. In FIGS. 2 and 3, arrows indicate a direction of flow or feed of air. In FIGS. 1 to 3, reference numeral 1 designates a casing which will be detailedly described hereinafter, and 2 is a motor including a rotor 21 and a stator 22. A two-phase DC brushless motor may be used as the motor 2. The stator 22 of the motor 2, as shown in FIG. 2, includes an iron core 23 and an exciting coil 24 wound on the core 23 and is mounted on a cylindrical boss section 12Ba provided on one closing wall 12B of the casing 1. The boss section 12Ba has a bearing holder 25 fitted therein, in which a pair of bearings 26 are arranged in a manner to be spaced from each other at a predetermined interval. Reference numeral 27 designates a revolving shaft of the motor 2, which is rotatably supported at one end thereof on the bearings 26 and fitted at the other end thereof in a hole formed at a bottom wall 28*a* of a cup-like member 28. The bearing holder 25 is mounted thereon with a circuit board 29 on which electronic components constituting a drive circuit are mounted. The cup-like member 28 also includes a peripheral wall 28*b*, which is mounted on an inner peripheral surface thereof with a plurality of magnetic poles each provided by a permanent magnet PM. The rotor 21 is constructed of a combination of the rotor 21, revolving shaft 27, cup-like member 28 and permanent magnets PM.

Reference numeral 3 designates an impeller which is securely mounted on the rotor 21 and includes a plurality of blades 31 arranged so as to permit air to be sucked from one side (suction side) in an axial direction of the revolving shaft 27 of the motor 2 and then guided mainly toward the other side (discharge side) in the axial direction. The impeller 3 also includes a ring section 30 fitted on the peripheral wall 28*b* of the cup-like member 28 of the rotor 21, on which the blades 31 are integrally provided. The blades 31 of the impeller 3 each are so configured and orientated that air sucked may be guided in a radial direction to the utmost.

Now, the casing 1 will be more detailedly described hereinafter. The casing 1 includes a pair of casing halves 101 and 102 each formed of a synthetic resin material such as polybutylene terephthalate or the like. The casing halves 101 and 102 include a closing wall 12A and the above-described closing wall 12B for closing both ends of the casing 1 in an axial direction thereof, respectively. The casing half 101, as shown in FIG. 3, is formed into a box-like shape wherein a surface thereof opposite to the closing wall 12A is rendered open. The casing half 101 includes four side walls 101*a* to 101*d*, of which the side wall 101 is formed with an opening 5*a*. Also, the closing wall 12A is formed at four corners thereof with through-holes 6*a* in which mounting screws are inserted. The other casing half 102 is likewise formed into a box-like configuration, wherein a surface thereof opposite to the closing wall 12B is formed with a hole of a circular shape. Thus, the casing half 102 includes four side walls 102*a* to 102*d*, of which the three aide walls 102*b* to 102*d* are formed with openings 5*b* to 5*d*, respectively. Also, it is formed at four corners thereof with through-holes 6*b* in which mounting screws are inserted, respectively.

The casing 1, as shown in FIGS. 1 and 2 and as described above, is constructed of the casing halves 101 and 102 in a pair, which are combined together to provide a space or cavity 4 in the casing 1. The casing 1 includes a peripheral wall 11, which is constructed of four side walls 11*a* to 11*d* each formed into an outer configuration of a rectangle as viewed in an axial direction thereof. The side walls 11*a* to 11*d* are constructed of a combination of the side walls of 1O1*a* to 102*d* of the casing halves 101 and 102. In the illustrated embodiment, the four side walls 11*a* to 11*d* cooperate with each other to provide a cylindrical wall 13 for surrounding the impeller 3 and a frame 14 arranged outside the cylindrical wall 13.

One of the four side walls 11*a* to 11*d* or the side wall 11*a* is provided at a portion thereof on the above-described discharge side with the opening 5*a* constituting a lateral discharge port which permits air to be discharged therethrough from the cavity 4 in the radial direction. As described above, in the illustrated embodiment, the opening 5*a* is formed at the side wall 101*a* of the casing half 101. Further, of the four side walls 11*a* to 11*d*, the remaining three side walls 11*b* to 11*d* are formed at a portion thereof on the suction side with the openings 5*b* to 5*d* each constituting a lateral suction port which permits air to be suckedly introduced therethrough into the cavity 4 in the radial direction, respectively. The openings 5*b* to 5*d*, as described above, are formed at the side walls 102*b* to 102*d* of the casing half 102, respectively.

In the illustrated embodiment, the opening or lateral discharge port 5*a* is formed and dimensioned so as to prevent air circulation which causes a large part of air discharged from the lateral discharge port 5*a* to be suckedly returned to the cavity 4 from the lateral suction ports or openings 5*b* to 5*d* and the opening 5*a* immediately after the discharge, resulting in improving a cooling function of the air fan. More specifically, a length L of the side wall 11*a* which is a dimension thereof in the axial direction of the revolving shaft 27 is determined so as to prevent each of the blades 31 of the impeller 3 from being fully exposed through the lateral discharge port or opening 5*a* at every time when the blade is rendered opposite to the port 5 during rotation of the impeller 3. The length L1 is determined depending on a size of the air fan and a capacity thereof. When the air fan has a size of 40 mm×40 mm×16 mm (thickness) and is rotated at a speed of 5,000 rpm, the dimension L1 is preferably about 5 mm or more. Also, a length L2 of the lateral discharge port 5 which is a dimension thereof in the axial direction of the revolving shaft 27 is preferably set so that a dimension of each of the blades 31 in the axial direction which is exposed therethrough is about 3 mm.

A width L3 of the opening 5*a* may be determined as desired. More particularly, a size of the opening 5*a* may be set depending on conditions under which the air fan is used while being received in the receiving housing of the electronic appliance. Thus, it is not limited to any specific value.

A width L4 of each of the openings 5*b* to 5*d* each constituting the lateral suction port may be determined as desired. In the illustrated embodiment, the openings 5*b* and 5*d* are formed into the same width and the opening 5*c* is formed into a width larger than that of the openings 5*b* and 5*d*, to thereby minimize air circulation from the opening 5*a* to the openings 5*b* and 5*d*. Alternatively, the openings 5*b* and 5*d* may be formed into the same size as the opening 5*c*. Such formation of the openings likewise would substantially prevent the air circulation because a direction of discharge of air from the opening 5*a* and that of suction of air from the openings 5*b* and 5*d* are perpendicular to each other. Also, a size of the openings may be determined as desired depending on conditions under which the air fan is used while being arranged in the receiving housing of the electronic appliance. Thus, it is not limited as defined in the illustrated embodiment.

In the illustrated embodiment, a configuration of the openings and a size thereof may be determined so that the casing 1 exhibits a satisfactory function also when the opening 5*a* acts as the lateral discharge port and the openings 5*b* to 5*d* act as the lateral suction ports, as in an embodiment of FIGS. 3 and 4 which will be described hereinafter.

When the air fan is so constructed that the opening 5*a* acts as the lateral discharge port as described above, the stator 22 of the motor 2 is fixed on the closing wall 12B, resulting in a sufficient space being provided between the blades 31 of the impeller 3 and the closing wall 12B. This, even when the end of the cavity on the suction side is closed with the closing wall 12B, ensures that air are smoothly sucked from the lateral suction ports or openings 5*b* to 5*d*.

Figure 4:
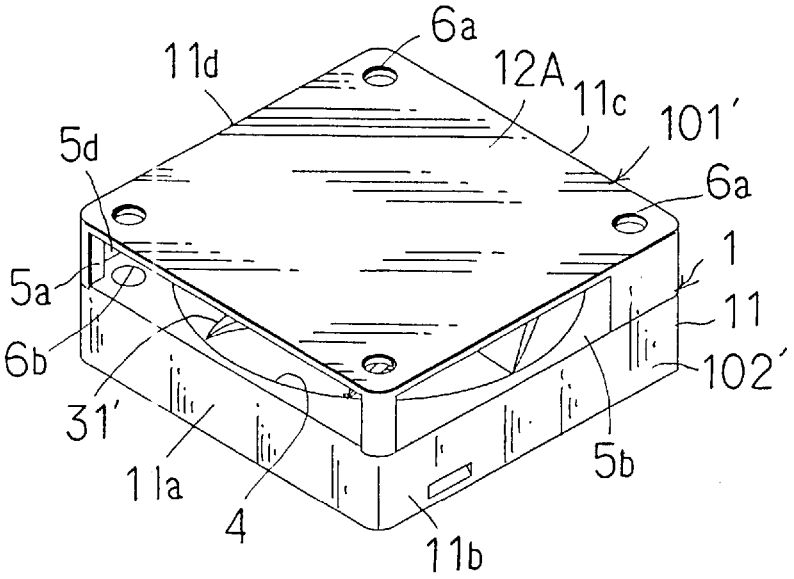
FIG. 4 is a perspective view showing another embodiment of an air fan according to the present invention.
Figure 5:
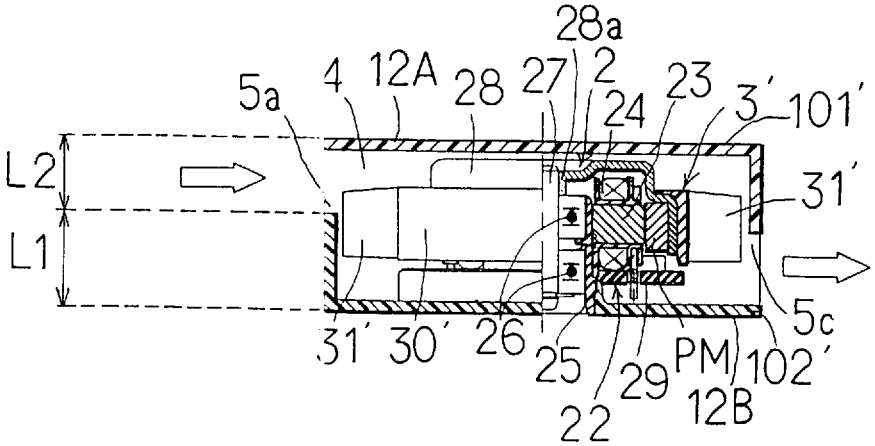
FIG. 5 is a sectional view of the air fan shown in FIG. 4.
Figure 6:
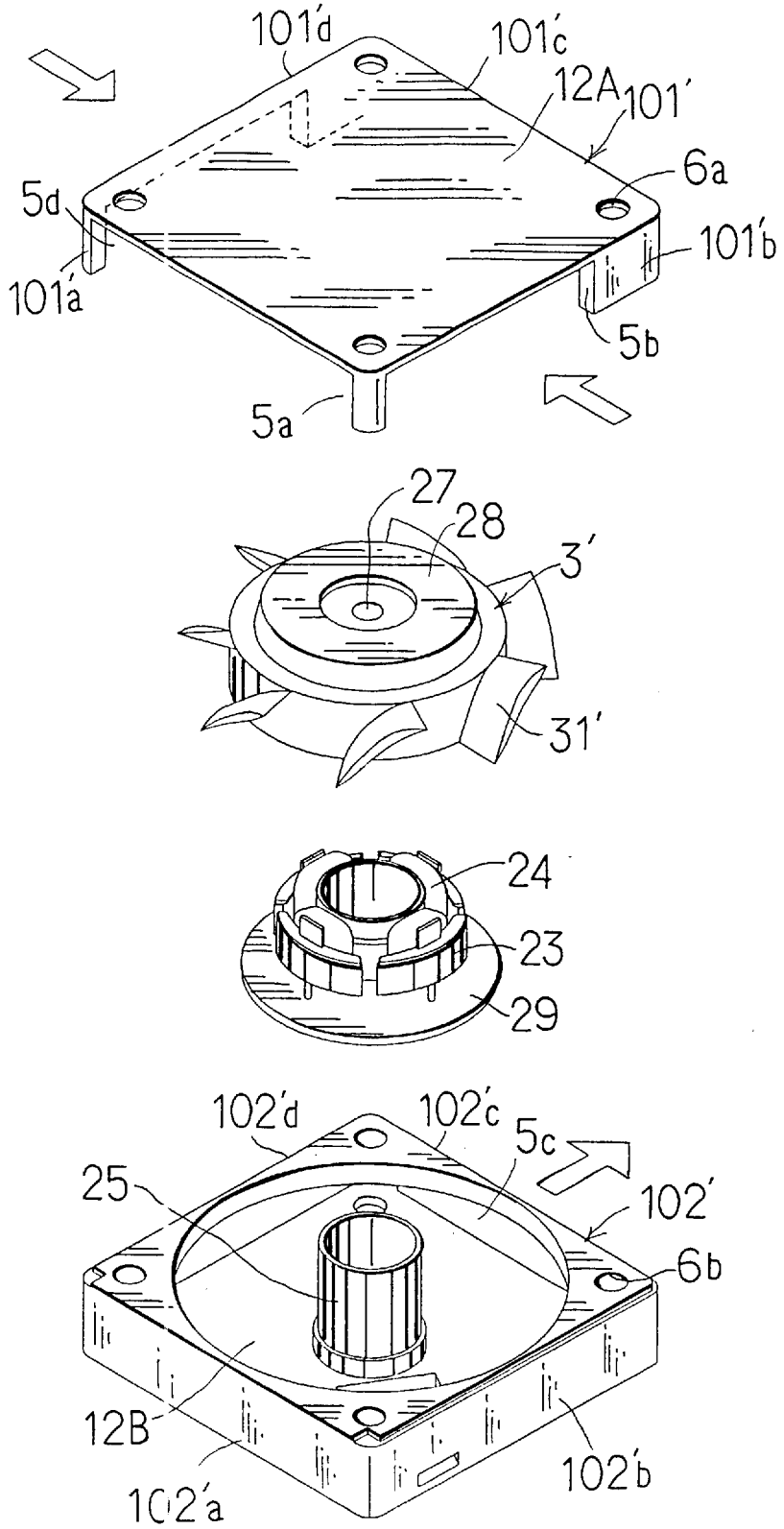
FIG. 6 is an exploded perspective view showing of the air fan shown in FIG. 4.

Referring now to FIGS. 4 to 6, another embodiment of an air fan according to the present invention is illustrated. An air fan of the illustrated embodiment is so constructed that one casing half 101' is formed with three openings 5*a*, 5*b* and 5*d* each acting as a lateral suction hole and the other casing half 102' is formed with an opening 5*c* acting as a lateral discharge port. Also, in the illustrated embodiment, blades 31' of an impeller 3' are arranged so as to guide air in a direction opposite to that in the embodiment of FIGS. 1 and 2. The remaining part of the illustrated embodiment may be constructed in substantially the same manner as the embodiment of FIGS. 1 and 2.

The illustrated embodiment is suitably arranged in a receiving housing of an electronic appliance such as a microcomputer which is reduced in depth or thickness, like the embodiment of FIGS. 1 to 3. A decrease in depth of the receiving housing causes a decrease in dimension of the air fan in an axial direction thereof. More specifically, it causes a distance between a closing wall 12A and the blades 31' to be reduced. Unfortunately, an excessive decrease in distance causes a failure in feeding of air. In general, an air fan is constructed so that rotation of blades leads to a reduction in pressure, to thereby cause air to flow from a high pressure region to a low pressure region. However, an excessive reduction in distance between the closing wall 12A and the blades would render in separation between the high pressure region and the low pressure region hazy or indistinct, to thereby fail in flowing of air. In other words, the closing wall 12A acts as a barrier between the low pressure region and the high pressure region (a central portion of the impeller), to thereby block flowing of air. Thus, it will be noted that the distance is highly significant for flowing of air.

Thus, in the illustrated embodiment, a thickness of the casing half 101 or a dimension L2 thereof in an axial direction thereof is determined so as to ensure that a space defined between the closing wall 12A of the casing 1 and the blades 31' establishes a suction pressure sufficient to permit a sufficient amount of air to be suckedly introduced through the lateral suction ports or openings 5*a*, 5*b* and 5*d* into a cavity 4. Thus, the dimension generates a pressure difference which permits air to flow in the space when the impeller 3' is rotated. Such formation of the casing half 101 permits a space required for establishing the suction pressure to be positively provided when the air fan of the illustrated embodiment is arranged in a receiving housing of any depth or thickness.

Supposing that the amount of air fed in the axial direction by a conventional axial fan is B1, that in the radial direction by the air fan of the illustrated embodiment is as small as about 0.3. For comparison, the amount of air fed by a conventional cirrocco fan intended to feed air in the radial direction is about 0.2 and, in order to accomplish the same air feeding, the cirrocco fan requires electric power increased by 15% or more as compared with the air fan of the illustrated embodiment.

The inventors made an experiment of air feeding by means of the air fan of the illustrated embodiment while suitably closing the openings 5*a*, 5*b* and/or 5*d*. As a result, it was found that the amount of air fed is decreased in order of (1) opening of all openings 5*a*, 5*b* and 5*d*, (2) opening of the openings 5*b* and 5*d* and closing of the opening 5*a*, (3) opening of one of the openings 5*b* and 5*d* and closing of the other opening 5*a*, (4) opening of the opening 5*b* or 5*d* and closing of the other openings and (5) opening of the opening 5*a* and closing of the other openings.

The results indicate that the air fan of the illustrated embodiment permits the amount of air fed to be maximum. The embodiment shown in FIGS. 1 to 3 exhibits substantially the same results.

A receiving housing of a microcomputer of the notebook type which is commercially available tends to be further decreased in depth or thickness. Thus, it is estimated that it will be required to reduce a thickness of an air fan received in the receiving housing to a level as small as 20 mm or less. However, the conventional cross-flow fan or cirrocco fan substantially fails to provide a required amount of air when it is reduced in thickness to such a level. It will be noted that the air fan of the present invention effectively solves such a problem as encountered with the prior art.

Figure 7:
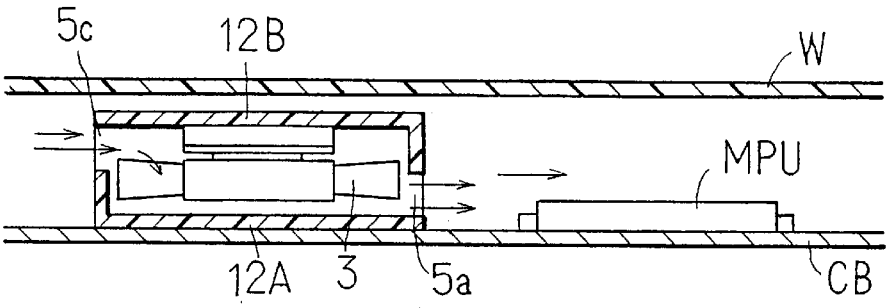
FIG. 7 is a schematic view of the air fan shown in FIG. 1 which is used as an air fan for cooling an electronic component or a DC brushless air fan for cooling an electronic component while being received in a receiving housing of an electronic appliance.

FIG. 7 schematically shows the air fan of FIG. 1 which is used as an air fan for cooling a microprocessor (electronic component) or a DC brushless air fan for cooling the electronic component while being received in a receiving housing of a microcomputer of the notebook type which is an electronic appliance. In FIG. 7, reference character W designates a wall of a receiving housing of an electronic appliance and MPU is a microprocessor mounted directly on a circuit board CB. In the illustrated modification, the air fan is mounted on the circuit board CB in a manner to be adjacent to the microprocessor MPU. Also, the air fan is so arranged that the lateral discharge port or opening 5*a* faces the microprocessor MPU. Such arrangement of the air fan permits the microprocessor MPU to be directly cooled.

Figure 8:
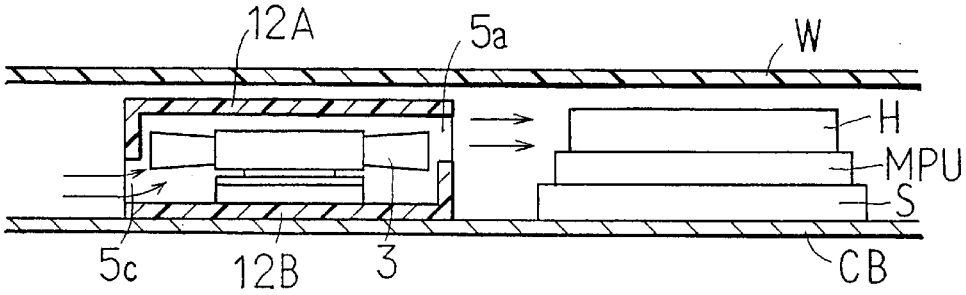
FIG. 8 is a schematic view showing an example of use of the air fan shown in FIG. 1 for cooling a heat sink for cooling a microprocessor.

FIG. 8 shows an example of arrangement of the air fan of FIG. 1 for cooling a heat sink H acting to cool a microprocessor MPU, wherein the air fan is fixed on the heat sink H. In FIG. 8, reference character S designates a socket for mounting a microprocessor MPU. In FIG. 8, the air fan is so arranged that the lateral discharge port or opening 5*a* faces the heat sink. Such arrangement of the air fan permits the microprocessor MPU to be cooled indirectly through the heat sink H directly cooled.

Figure 9:
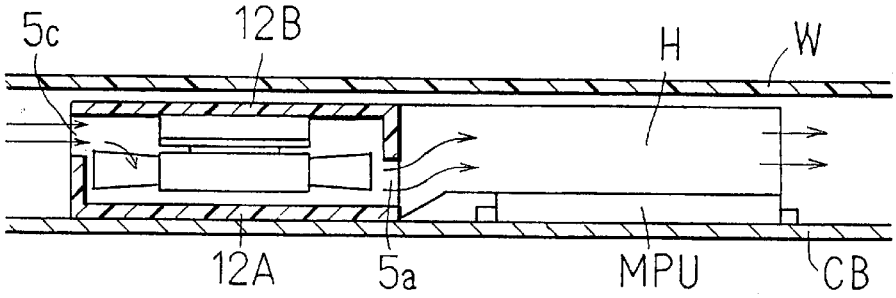
FIG. 9 is a schematic view showing another example of use of the air fan shown in FIG. 1 for cooling a heat sink for cooling a microprocessor.

FIG. 9 shows another example of arrangement of the air fan of FIG. 1 for cooling a heat sink H acting to cool a microprocessor MPU, wherein the air fan is fixed on the heat sink H. Likewise, the air fan is so arranged that the lateral discharge port or opening 5*a* faces the heat sink. In the example, the heat sink H is constructed so as to effectively receive air from the air fan and the microprocessor MPU is mounted directly on a circuit board CB without a socket S, unlike the arrangement shown in FIG. 8.

Figure 10:
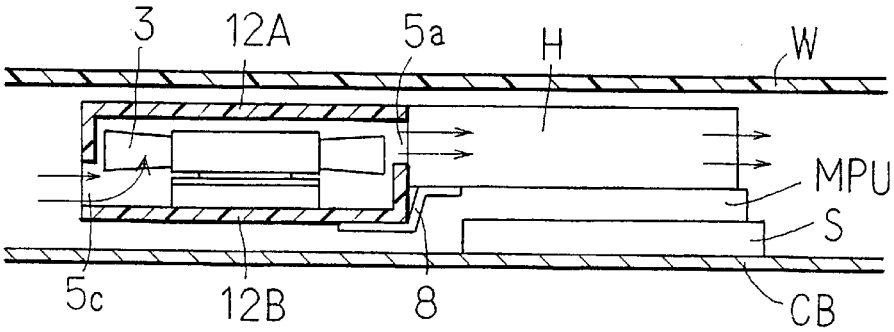
FIG. 10 is a schematic view of the air fan shown in FIG. 1 which is securely mounted on a heat sink for cooling a microprocessor.

FIG. 10 shows a further example of arrangement of the air fan of FIG. 1 for cooling a heat sink H serving to cool a microprocessor MPU, wherein the air fan is fixed on the heat sink H. The air fan is screwed on a fitment 8 provided on the heat sink H through the mounting holes 6*a* of the casing 1. In the example as well, the air fan is arranged so that the lateral discharge port or opening 5*a* faces the heat sink H. Such arrangement of the air fan likewise permits the microprocessor MPU to be cooled indirectly through the heat sink H directly cooled. It is a matter of course that the fitment 8 may be formed in a manner to be integral with the heat sink H.

In the example shown in each of FIGS. 8 to 10, the air fan is intended to feed air directly to the electronic component. Alternatively, the air fan may be intended to discharge air in the receiving housing to an exterior thereof or introduce ambient air into the receiving housing.

As can be seen from the foregoing, the air fan of the present invention is so constructed that the peripheral wall of the casing is provided with the lateral suction ports and lateral discharge port, which are arranged so as not to be aligned with each other in the axial direction, to thereby prevent air circulation which causes a large part of air discharged from the lateral discharge port to be suckedly introduced into the cavity through the lateral suction holes immediately after the discharge. Such construction permits air sucked from the lateral suction ports to be discharged in the radial direction from the lateral discharge port, to thereby ensure feeding of air in a sufficient amount. In particular, the air fan of the present invention eliminates a necessity of providing any specific space on each of both sides in the axial direction thereof, because the cavity is closed at both ends thereof in the axial direction. Thus, arrangement of the air fan of the present invention for cooling an electronic component of an electronic appliance is significantly facilitated.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An air fan comprising:

a motor including a rotor and a stator;

an impeller securely mounted on said rotor and including a plurality of blades for sucking air from one side in an axial direction of a revolving shaft of said motor and guiding sucked air mainly toward the other side in said axial direction; and a casing including a peripheral wall arranged so as to define a cavity therein in which said motor and impeller are received;

said casing including closing walls for closing both ends of said cavity defined in said axial direction;

said peripheral wall of said casing being provided at a portion thereof surrounding the impeller and in proximity to the closing wall on said one side with at least one lateral suction port which permits air to be suckedly introduced therethrough into said cavity in a radial direction of said revolving shaft;

said peripheral wall of said casing being provided at a portion thereof surrounding the impeller and in proximity to the closing wall on said the other side with at least one lateral discharge port which permits said air suckedly introduced into said cavity to be discharged therethrough in the radial direction of said revolving shaft;

said lateral suction port and lateral discharge port being arranged so as not to be aligned with each other in said axial direction.

2. An air fan as defined in claim 1, wherein said blades of said impeller are arranged so as to guide said sucked air toward said radial direction.

3. An air fan as defined in claim 1, wherein said closing wall of said casing on said one side cooperates with said blades to define a space therebetween;

said space being formed so as to establish a suction pressure sufficient to permit a sufficient amount of air to be suckedly introduced through said lateral suction port into said cavity.

4. An air fan as defined in claim 1, wherein said closing wall of said casing on said one side cooperates with said blades to define a space therebetween; and said peripheral wall of said casing is formed into a length in said axial direction so that said space may establish a suction pressure sufficient to permit a sufficient amount of air to be sucked through said lateral suction port into said cavity.

5. An air fan as defined in claim 1, wherein said closing wall of said casing on said one side cooperates with said blades to define a space therebetween; and said closing wall of said casing on said one side is arranged so as to be spaced at a minimum interval from said blades;

said minimum interval being determined so that said space may establish a suction pressure sufficient to permit a sufficient amount of air to be suckedly introduced through said lateral suction port into said cavity.

6. An air fan as defined in claim 1, wherein said lateral suction port and lateral discharge port are arranged so as to prevent a large amount of air discharged from said lateral discharge port to be suckedly returned through said lateral suction port to said cavity immediately after discharge.

7. A DC brushless air fan comprising:

a DC brushless motor including a rotor and a stator;

an impeller securely mounted on said rotor and including a plurality of blades for sucking air from one side in an axial direction of a revolving shaft of said motor and guiding sucked air mainly toward the other side in said axial direction; and a casing including a peripheral wall arranged so as to define a cavity therein in which said motor and impeller are received;

said casing including closing walls for closing both ends of said cavity defined in said axial direction;

said peripheral wall being formed of four side walls into a substantially rectangular outer configuration;

at least one of said side walls of said peripheral wall of said casing being provided at a portion thereof in proximity to an end thereof on said one side with at least one lateral suction port which permits air to be suckedly introduced therethrough into said cavity in a radial direction of said revolving shaft;

at least one of the remaining side walls of said peripheral wall of said casing being provided at a portion thereof in proximity to an end thereof on said the other side with at least one lateral discharge port which permits said air suckedly introduced into said cavity to be discharged therethrough in the radial direction of said revolving shaft.

8. A DC brushless air fan as defined in claim 7, wherein said lateral suction port is provided at at least one side wall adjacent to the side wall provided with said lateral discharge port.

9. A DC brushless air fan as defined in claim 7, wherein said lateral suction port is provided at each of the side walls other than said side wall provided with said lateral discharge port.

10. A DC brushless air fan as defined in claim 7, wherein said casing is constructed of a pair of casing halves each including each of said closing walls.

11. A DC brushless air fan as defined in claim 10, wherein one of said casing halves is provided with said lateral suction port and the other of said casing halves is provided with said lateral discharge port.

12. An air fan for cooling an electronic component which is adapted to be received in a receiving housing of an electronic appliance to cool an electronic component received in the receiving housing, comprising:

a motor including a rotor and a stator;

an impeller securely mounted on said rotor and including a plurality of blades for sucking air from one side in an axial direction of a revolving shaft of said motor and guiding sucked air mainly toward the other side in said axial direction; and a casing including a peripheral wall arranged so as to define a cavity therein in which said motor and impeller are received;

said casing including closing walls for closing both ends of said cavity defined in said axial direction;

said peripheral wall of said casing being provided at a portion thereof surrounding the impeller and in proximity to the closing wall on said one side with at least one lateral suction port which permits air to be suckedly introduced therethrough into said cavity in a radial direction of said revolving shaft;

said peripheral wall of said casing being provided at a portion thereof surrounding the impeller and in proximity to the closing wall on said the other side with at least one lateral discharge port which permits said air suckedly introduced into said cavity to be discharged therethrough in the radial direction of said revolving shaft;

said lateral suction port and lateral discharge port being arranged so as to prevent air circulation which causes a large amount of air discharged from said lateral discharge port to be suckedly returned through said lateral suction port to said cavity immediately after the discharge.

13. An electronic appliance having an air fan for cooling an electronic component or an electronic component with a heat sink incorporated therein, wherein said air fan comprises a motor including a rotor and a stator, an impeller securely mounted on said rotor and including a plurality of blades for sucking air from one side in an axial direction of a revolving shaft of said motor and guiding sucked air mainly toward the other side in said axial direction, and a casing including a peripheral wall arranged so as to define a cavity therein in which said motor and impeller are received;

said casing including closing walls for closing both ends of said cavity defined in said axial direction;

said peripheral wall of said casing being provided at a portion thereof surrounding the impeller and in proximity to the closing wall on said one side with at least one lateral suction port which permits air to be suckedly introduced therethrough into said cavity in a radial direction of said revolving shaft;

said peripheral wall of said casing being provided at a portion thereof surrounding the impeller and in proximity to the closing wall on said the other side with at least one lateral discharge port which permits said air suckedly introduced into said cavity to be discharged therethrough in the radial direction of said revolving shaft;

said lateral suction port and lateral discharge port being arranged so as to prevent air circulation which causes a large amount of air discharged from said lateral discharge port to be suckedly returned through said lateral suction port to said cavity immediately after the discharge;

said air fan is juxtaposed to said electronic component while being adjacent to said electronic component; and said air fan is arranged so as to permit air discharge through said lateral discharge port to be directly blown against said electronic component or said heat sink.

14. An electronic appliance having an electronic component, an air fan for cooling said electronic component, and a circuit board incorporated therein, comprising:

a receiving housing in which said air fan and electronic component are received;

said air fan including a motor which includes a rotor and a stator, an impeller securely mounted on said rotor and including a plurality of blades for sucking air from one side in an axial direction of a revolving shaft of said motor and guiding sucked air mainly toward the other side in said axial direction, and a casing which includes a peripheral wall arranged so as to define a cavity therein in which said motor and impeller are received;

said casing including closing walls for closing both ends of said cavity defined in said axial direction;

said peripheral wall of said casing being provided at a portion thereof surrounding the impeller and in proximity to the closing wall on said one side with at least one lateral suction port which permits air to be suckedly introduced therethrough into said cavity in a radial direction of said revolving shaft;

said peripheral wall of said casing being provided at a portion thereof surrounding the impeller and in proximity to the closing wall on said the other side with at least one lateral discharge port which permits said air suckedly introduced into said cavity to be discharged therethrough in the radial direction of said revolving shaft; and said air fan being arranged in said receiving housing so that said casing is abutted against an inner surface of said receiving housing or a surface of said circuit board.

15. An electronic appliance having an air fan for cooling an electronic component with a heat sink incorporated therein, wherein said air fan comprises a motor including a rotor and a stator, an impeller securely mounted on said rotor and including a plurality of blades for sucking air from one side in an axial direction of a revolving shaft of said motor and guiding sucked air mainly toward the other side in said axial direction, and a casing including a peripheral wall arranged so as to define a cavity therein in which said motor and impeller are received;

said casing including closing walls for closing both ends of said cavity defined in said axial direction;

said peripheral wall of said casing being provided at a portion thereof surrounding the impeller and in proximity to the closing wall on said one side with at least one lateral suction port which permits air to be suckedly introduced therethrough into said cavity in a radial direction of said revolving shaft;

said peripheral wall of said casing being provided at a portion thereof surrounding the impeller and in proximity to the closing wall on said the other side with at least one lateral discharge port which permits said air suckedly introduced into said cavity to be discharged therethrough in the radial direction of said revolving shaft;

said lateral suction port and lateral discharge port being arranged so as to prevent air circulation which causes a large amount of air discharged from said lateral discharge port to be suckedly returned through said lateral suction port to said cavity immediately after the discharge; and said air fan being mounted on said heat sink.

* * * * *